US009955850B2

(12) United States Patent
Isbilen

(10) Patent No.: US 9,955,850 B2
(45) Date of Patent: May 1, 2018

(54) DOMESTIC DISHWASHER HAVING ADJUSTABLE RACK

(71) Applicant: BSH Hausgeräte GmbH, Munich (DE)

(72) Inventor: Ersin Isbilen, Lauingen (DE)

(73) Assignee: BSH Hausgeräte GmbH, Munich (DE)

( * ) Notice: Subject to any disclaimer, the term of this patent is extended or adjusted under 35 U.S.C. 154(b) by 0 days. days.

(21) Appl. No.: 15/523,956

(22) PCT Filed: Oct. 30, 2015

(86) PCT No.: PCT/EP2015/075219

§ 371 (c)(1),
(2) Date: May 3, 2017

(87) PCT Pub. No.: WO2016/078892

PCT Pub. Date: May 26, 2016

(65) Prior Publication Data

US 2017/0332878 A1 Nov. 23, 2017

(30) Foreign Application Priority Data

Nov. 17, 2014 (DE) ..... 10 2014 223 373

(51) Int. Cl.
*A47L 15/50* (2006.01)

(52) U.S. Cl.
CPC ..... *A47L 15/503* (2013.01); *A47L 15/50* (2013.01)

(58) Field of Classification Search
CPC ..... A47L 15/50; A47L 15/503
USPC ..... 134/56 D, 57 D, 58 D; 312/248, 323; 211/41.8; 220/488, 666
See application file for complete search history.

(56) References Cited

U.S. PATENT DOCUMENTS 2,910,207 A * 10/1959 Andrew ..... A47L 15/50 134/151
3,853,364 A * 12/1974 Lundberg ..... B42F 15/06 312/184
5,497,890 A * 3/1996 Clark ..... A47L 15/503 211/198
6,092,687 A * 7/2000 Hupp ..... B65D 43/162 220/315
7,789,258 B1 * 9/2010 Anderson ..... E01F 13/06 220/1.5
2005/0028847 A1 2/2005 Kaczmarek
2007/0159040 A1 * 7/2007 Fernandez ..... B25H 3/023 312/348.3

(Continued)

FOREIGN PATENT DOCUMENTS

DE 29621525 U1 4/1998

OTHER PUBLICATIONS

International Search Report PCT/EP2015/075219 dated Dec. 10, 2015.

*Primary Examiner* — Michael Safavi
(74) *Attorney, Agent, or Firm* — Michael E. Tschupp; Andre Pallapies; Brandon G. Braun

(57) ABSTRACT

A rack for a domestic dishwasher includes a frame and a base. The base can be swung and folded out in order to increase a loading volume of the rack. The base includes a first portion articulated to a first side of the frame via a first articulation, and a second portion articulated to a second side of the frame opposite the first site via a second articulation, and articulated to the first portion via a third articulation. The second portion is configured to change its length between the second and third articulations.

28 Claims, 5 Drawing Sheets

(56) References Cited

U.S. PATENT DOCUMENTS

| | | | | |
|---|---|---|---|---|
| 2007/0246090 | A1* | 10/2007 | Anderson | A47L 15/0084 134/58 D |
| 2008/0302789 | A1* | 12/2008 | Stevenson | B65D 7/26 220/4.33 |
| 2010/0078048 | A1 | 4/2010 | Schessl et al. | |
| 2010/0155280 | A1 | 6/2010 | Graute et al. | |
| 2010/0314977 | A1* | 12/2010 | Mallory | A47L 15/503 312/228.1 |
| 2011/0062167 | A1* | 3/2011 | Colton | B65D 19/18 220/666 |
| 2012/0222711 | A1 | 9/2012 | Forst et al. | |
| 2014/0190528 | A1* | 7/2014 | Wegener | A47L 15/502 134/92 |
| 2015/0245761 | A1 | 9/2015 | Zhou et al. | |

* cited by examiner

DOMESTIC DISHWASHER HAVING ADJUSTABLE RACK

CROSS-REFERENCES TO RELATED APPLICATIONS

This application is the U.S. National Stage of International Application No. PCT/EP2015/075219, filed Oct. 30, 2015, which designated the United States and has been published as International Publication No. WO 2016/078892 A1 and which claims the priority of German Patent Application, Serial No. 10 2014 223 373.9, filed Nov. 17, 2014, pursuant to 35 U.S.C. 119(a)-(d).

BACKGROUND OF THE INVENTION

The invention relates to a rack for a domestic dishwasher. The invention also relates to a domestic dishwasher.

Depending on the items to be washed, it may be advantageous to change a loading volume of a rack. For example, it may happen that, depending on the loading of an upper basket, more space is available above the upper basket than is required for example by an existing flatware drawer.

A flatware drawer for a dishwasher is known from the publication DE 10 2008 062 761 B3, said flatware drawer having several inserts arranged in a movable manner on the frame, it being possible to position the dish elements to be washed thereon, with one of the inserts being arranged on the frame in such a manner that it can be displaced horizontally and with at least one further insert being arranged on the frame in such a manner that it can be displaced vertically.

BRIEF SUMMARY OF THE INVENTION

Against this background it is the object of the present invention to provide an improved rack and an improved domestic appliance.

A rack for a domestic dishwasher with a frame and a base that can be folded out to increase a loading volume of the rack is therefore proposed, the base having at least one first portion, which is articulated to a first side of the frame by means of at least one first articulation, and a second portion, which is articulated to the first portion by means of at least one second articulation and is articulated to a second side of the frame opposite the first side by means of at least one third articulation, at least one of the portions being designed to change length between its respective articulations.

In particular the articulations provided allow the base to be lowered for example downward by the pivoting or folding of the articulations, thereby increasing the loading volume of the rack. The at least one portion that can change length allows the length of the base to be adjusted when the articulations are pivoted.

The base of the rack can be folded back in again after being folded out. It is thus possible to arrange the first portion and the second portion one above the other, in other words the first portion and the second portion lie one above the other in the vertical direction when the rack is used in a domestic dishwasher. The articulations can also be configured for example as hinge articulations. The articulations can also be pivoted through a range from 0° to 180°, preferably from 0° to 270°, even more preferably from 0° to 360°.

A portion can be configured in particular as a long and/or flat element. For example the portion can be a bar, a wire or a plate. The portion can also have a grid-type or net-type structure. The portion can preferably be made of plastic and/or metal.

According to one embodiment the at least one portion has at least two elements that can telescope into one another.

Telescopic elements allow a portion to change length in a simple manner.

According to a further embodiment the base can be transitioned at least between a first state and a second state by pivoting the portions, the base being parallel to an insertion plane, which is spanned by an insertion direction of the rack into the domestic dishwasher and a widthwise direction of the domestic dishwasher, when the rack is used in the domestic dishwasher in the first state, and the base being at least partially at an angle to the insertion plane when the rack is used in the domestic dishwasher in the second state.

The first state refers in particular to a state in which a loading volume is not increased by folding out. In other words the first state corresponds to the normal state of the rack. In the first state the base runs substantially parallel to the insertion plane, in which the rack is inserted, when the rack is used in the domestic dishwasher. In other words horizontal or parallel to a base or top of the domestic dishwasher. In the second state the base of the rack is folded out by pivoting the first and second portions relative to one another in a vertical direction. This allows the loading volume of the rack to be increased. For example at least one portion of the domestic dishwasher can run at an angle to the insertion plane here.

According to a further embodiment the base has at least one third portion, which is articulated to one of the at least two portions of the base by means of at least one fourth articulation.

A third portion increases the variability of the rack.

According to a further embodiment the base has a total of five portions, which are articulated to one another by means of articulations.

Five portions allow the variability of the rack to be increased further. In particular the number of possible states of the rack with different loading volumes can be increased.

According to a further embodiment a first portion of the five portions is articulated to the first side of the rack by means of a first articulation, a second portion is articulated to the second side of the rack by means of a second articulation, a third portion is articulated to the first portion by means of a third articulation, a fourth portion is articulated to the third portion by means of a fourth articulation and a fifth portion is articulated to the fourth portion by means of a fifth articulation and to the second portion by means of a sixth articulation.

In particular the first and third portions can be of equal length. The second and fifth portions can also be of equal length. The first, second, third and fifth portions can preferably be of equal length.

According to a further embodiment the rack can also be transitioned to a third state, in which the base is at least partially parallel to the insertion plane when the rack is used in the domestic dishwasher in the third state, and the loading volume in the third state is greater than the loading volume in the first and second states.

For example the third state has the advantage that a flat surface can be provided in the rack when it has been folded out to increase the loading volume.

According to a further embodiment the base is parallel to the insertion plane over an entire projected surface of the frame onto the insertion plane in the third state.

In particular the third state can provide a flat surface that corresponds to the surface of the area spanned by the frame. This for example allows a flatware drawer to be converted to an upper basket or lower basket.

According to a further embodiment the rack has a locking apparatus which is designed to lock the rack at least in the first state and/or to release it into the second and/or third state from the first state.

The locking apparatus has the advantage that the rack can be held in one state. As a result it can be moved in particular out of the domestic dishwasher without the state of the rack changing.

According to a further embodiment the locking apparatus locks at least one portion of the base and/or at least one articulation to lock the rack in the first state.

For example the locking apparatus can clamp a portion of the base and/or limit a movement radius of an articulation.

According to a further embodiment the locking apparatus is also designed to lock a first portion of the base in a first position and to lock the first and a second portion of the base in a second position.

This allows the rack to be folded out step by step for example.

According to a further embodiment the locking apparatus has at least two parts, the first part of the locking apparatus being arranged on the first side of the frame and being designed to lock a portion of the base articulated to the first side of the frame and the second part of the locking apparatus being arranged on the second side of the frame and being designed to lock a portion of the base articulated to the second side of the frame.

According to a further embodiment the two parts of the locking apparatus lock a portion of the base independently of one another.

In particular this allows the sides of the rack to be folded out independently of one another.

According to a further embodiment the base has at least two further portions, one of the at least two further portions being articulated to a third side of the frame by means of at least one further articulation and a second portion of the at least two further portions being articulated to a fourth side of the frame by means of at least one further articulation, the third side being perpendicular to the first side and the fourth side being opposite the third side.

In particular this allows the rack to be folded out on all four sides. For example it allows a rack to be provided which can be folded out both to the sides as well as to the front or rear when used in a domestic dishwasher.

According to a further embodiment the rack is configured as a flatware drawer.

A dishwasher with at least one rack as described above is also proposed.

It should be noted that the terms "first", "second" and so on portion or "first", "second" and so on articulation are used here. This is only for the purposes of clearer distinction. It is always possible to change the term from for example "fourth" to "second" as required.

Further possible implementations of the invention also include combinations, which are not specifically cited, of features or embodiments which are described above or in the following with reference to the exemplary embodiments. In so doing the person skilled in the art will also add individual aspects to improve or supplement the respective basic form of the invention.

BRIEF DESCRIPTION OF THE DRAWINGS

Further advantageous configurations and aspects of the invention are set out in the subclaims and in the exemplary embodiments of the invention described in the following. The invention is described in more detail below based on preferred embodiments with reference to the accompanying figures, in which

DETAILED DESCRIPTION OF EXEMPLARY EMBODIMENTS OF THE PRESENT INVENTION

Figure 1:
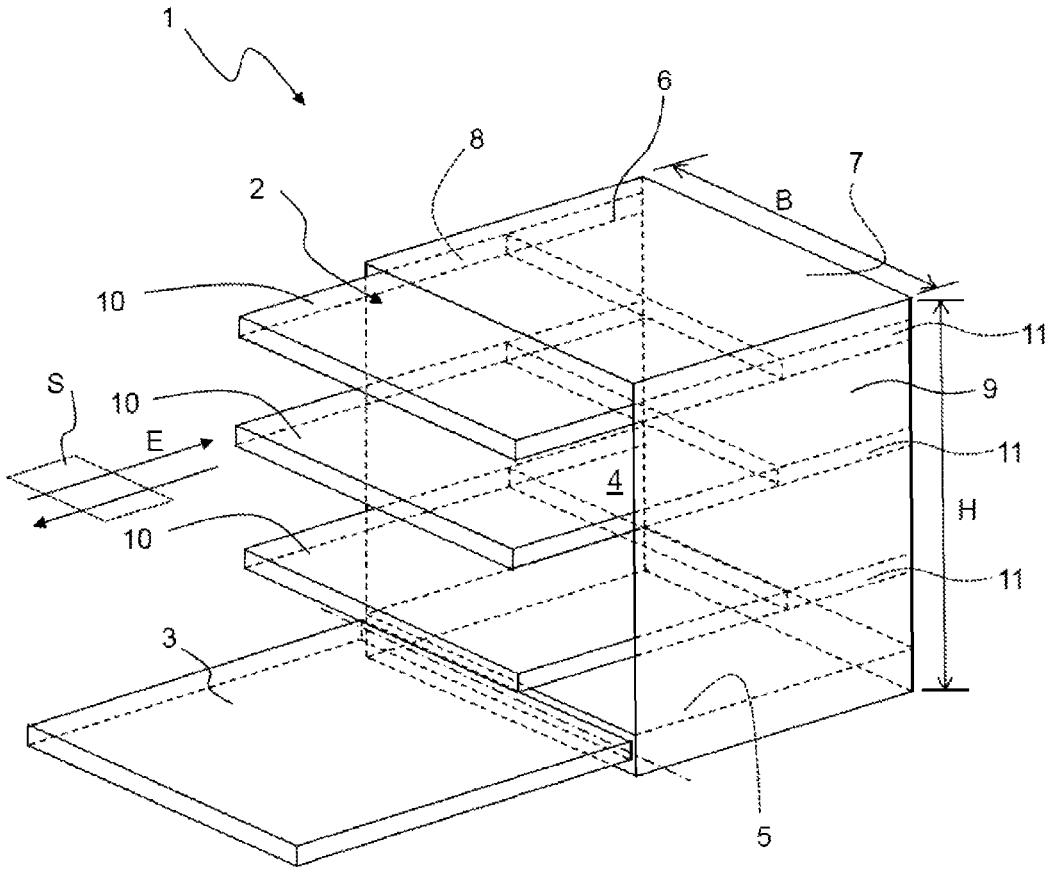
FIG. 1 shows a schematic view of a domestic dishwasher.

Identical elements and those of identical function are shown with the same reference characters in the figures, unless otherwise specified.

FIG. 1 shows a schematic perspective view of a domestic dishwasher 1. The domestic dishwasher 1 has a carcass 2, which can be closed by a door 3 in a watertight manner.

The carcass 2 is preferably cuboidal. In particular the carcass 2 is made of sheet steel. Alternatively at least portions of the carcass 2 can be made of a plastic material. The carcass 2 and door 3 can form a wash chamber 4 for washing items to be washed. The carcass 2 can be arranged in the interior of a housing of the domestic dishwasher 1. The door 3 is shown in its open position in FIG. 1. The door 3 can be closed or opened by pivoting about a pivot axis provided at a lower end of the door 3.

The carcass 2 has a base 5, a top 6 arranged opposite the base 5, a rear wall 7 arranged opposite the door 3 and two side walls 8, 9 arranged opposite one another. The base 5, top 6, rear wall 7 and side walls 8, 9 can be made of stainless steel for example.

The domestic dishwasher 1 also has at least one rack 10. In particular several racks 10 can be provided, with one of the several racks 10 respectively being an upper basket or a lower basket of the domestic dishwasher 1. The rack can also be a flatware drawer.

The several racks 10 are preferably arranged one above the other in the carcass 2. In particular a guide facility 11 is assigned to each rack 10. The guide facility 11 is used to move the respective rack 10 into the carcass 2 (insertion direction E) or out of it. In this process a respective guide facility 11 guides the respective rack 10 in a respective insertion plane S. The respective insertion plane S is spanned by the insertion direction E and the widthwise direction B of the domestic dishwasher, and a location of the respective guide facility 11 in a heightwise direction H of the domestic dishwasher 1 determines the position of the respective insertion plane S in the heightwise direction H.

Figure 2:
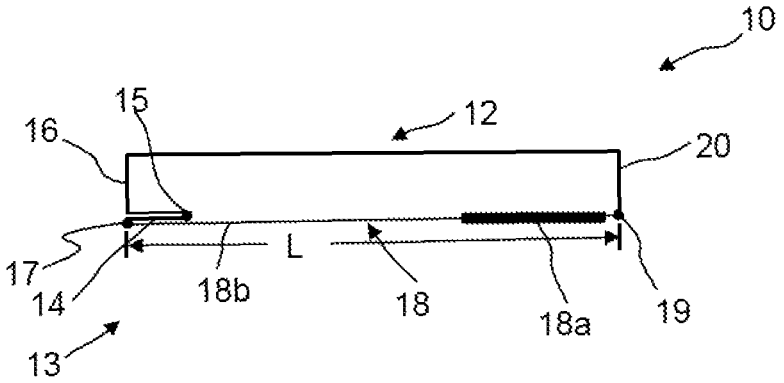
FIGS. 2 and 3 show schematic sectional views through a rack according to one embodiment in a first and second state.

FIG. 2 shows a schematic sectional view through a rack 10 in a first state. The rack 10 has a frame 12 and a base 13. The frame 12 can have a rectangular shape and four sides. FIG. 2 shows a first side 16 and a second side 20 of the frame 12. A first portion 14 of the base 13 is articulated to the first side 16 by means of a first articulation 15. As shown in FIG. 2, one side 16 or several sides of the rack can be L-shaped.

A second portion 18 is articulated to the second side 20 of the frame 12 by means of a second articulation 19. The first portion 14 and the second portion 18 are connected to one another by means of a third articulation 17. In the embodiment of the rack 10 shown in FIG. 2 the second portion 18 is designed to change length L. To this end the second portion 18 has two elements 18*a*, 18*b*, which can be telescoped into one another.

When the rack 10' is in the first state, the second portion 18 of the base runs parallel to an insertion plane S of the rack. In other words the second portion 18 of the base 13 is parallel to the base 5 or top 6 of the domestic dishwasher 1 when the rack 10 is used in the domestic dishwasher 1. A locking apparatus 29 (FIG. 6) allows the rack 10 to be locked in the first state. Releasing the locking apparatus 29 (FIG. 6) allows the base 13 of the rack 10 to be folded out, thereby transitioning the rack 10 to the second state shown in FIG. 3. In particular folding out can take place with the aid of gravity.

Figure 3:
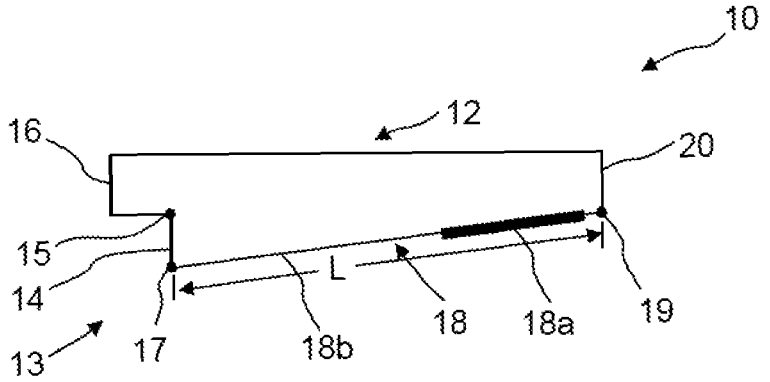

FIG. 3 shows the rack 10 from FIG. 2 in a second state. As the rack 10 transitions between the first and second states, the second portion 18 changes length L. In the second state the second portion 18 runs at an angle to the insertion plane S. This increases the loading volume of the rack.

Figure 4:
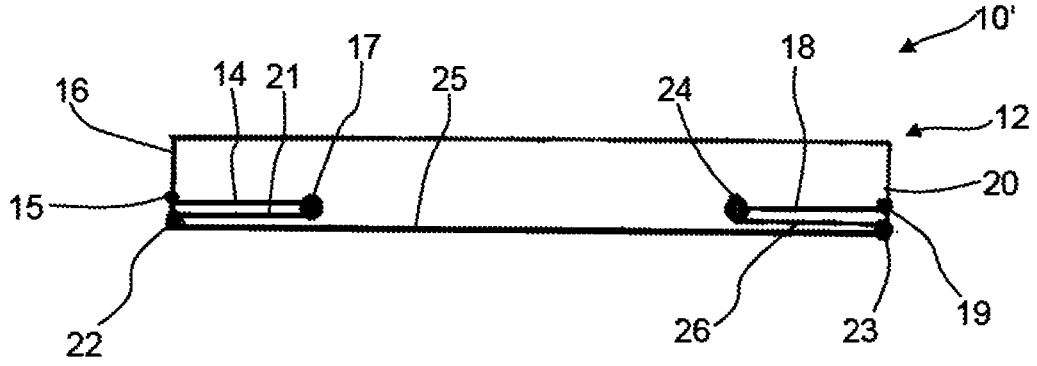
FIG. 4 shows a schematic sectional view through a rack according to a further embodiment.

FIG. 4 shows a schematic sectional view of a rack 10' according to a further embodiment. The rack 10' shown in FIG. 4 has a total of five portions, which form the base 13. A first portion 14 here is articulated to the first side 16 of the rack 10' by means of a first articulation 15. A second portion 18 is articulated to the second side 20 of the rack 10' by means of a second articulation 19. A third portion 21 is articulated to the first portion 14 by means of a third articulation 17. The first and third portions 14, 21 can in particular be of equal length.

A fourth portion 25 is articulated to the third portion 21 by means of a fourth articulation 22. In particular the fourth portion 25 can change length. A fifth portion 26 is connected to the fourth portion 25 by means of a fifth articulation 23. The fifth portion 26 is connected to the second portion 18 by means of a sixth articulation 24. In particular the second and fifth portions 18, 26 can be of equal length.

In FIG. 4 the rack 10' is shown in a first state, in which the base is parallel to the insertion plane S. In particular in the first state all the portions 14, 18, 21, 25, 26 can be parallel to the insertion plane S. This means that some of the portions are arranged one above the other in the heightwise direction H of the domestic dishwasher.

FIGS. 5A to 5D show different further states of the rack 10' from FIG. 4. To transition the rack 10' from the first state, which is shown in FIG. 4, to the further states shown in FIGS. 5A to 5D, either one portion or several portions of the base 13 is/are folded out. Folding out increases the loading volume of the rack 10'.

Figure 5A:
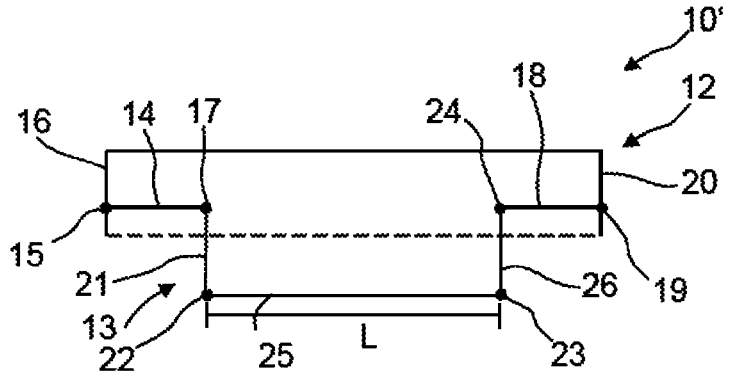
FIGS. 5A to 5D show schematic sectional views through a rack according to the further embodiment in different states.

In FIG. 5A a portion 21, 26 on both the first and second sides 16, 20 of the rack 10' is folded out. In other words the third portion 21 and fifth portion 26 of the base 13 run in a vertical direction or in the heightwise direction H of the domestic dishwasher 1. In particular the portion 25, which can change length, has its shortest length L in this state. The broken line in FIG. 5A shows the profile of the changing length of the fourth portion 25 in the first state.

Figure 5B:
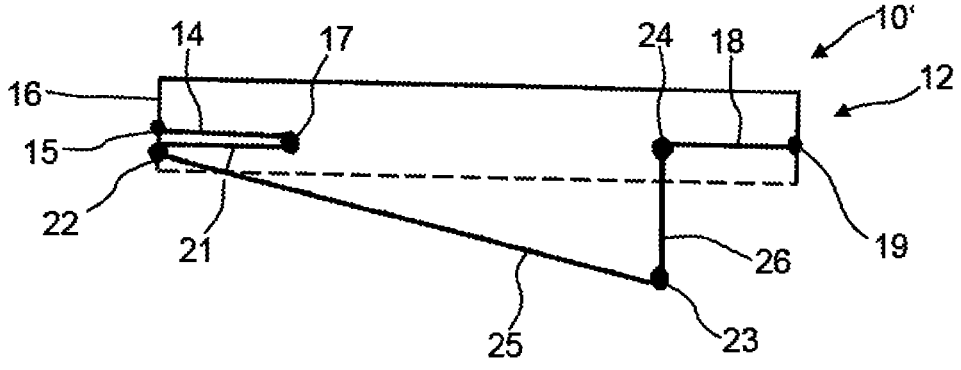
Figure 5C:
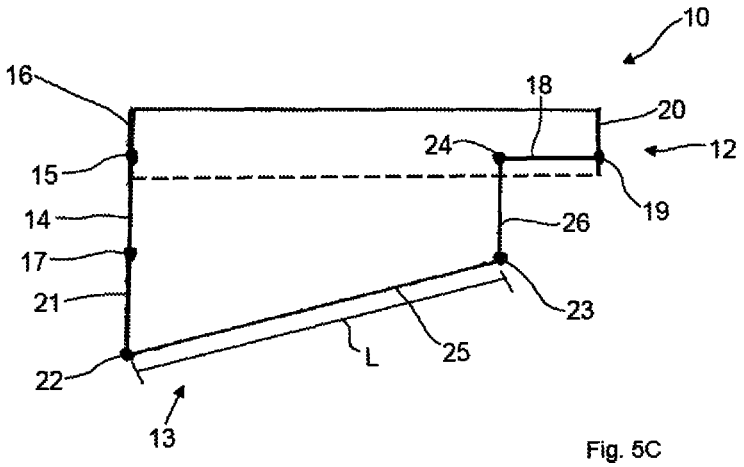

FIGS. 5B and 5C show states in which at least one portion of the base 13 runs at an angle to the insertion plane S. FIG. 5B shows a state in which the first and third portions 14 and 21 are one above the other on the first side 16, while the fifth portion 26 is folded down on the second side 20. This state can be reached from the first state (FIG. 4) by pivoting the sixth articulation 24. Similarly the rack 10' can be transitioned to a state mirroring the state shown in FIG. 5B by pivoting the second articulation 19. FIG. 5C shows a state in which both the first and third portions 14 and 21 are folded out on the first side 16 while the fifth portion 26 is folded down on the second side 20. This state can be reached from the state in FIG. 5B by pivoting the first and third articulations 15, 17. Similarly the rack 10' can be transitioned to a state mirroring the state shown in FIG. 5C.

Figure 5D:
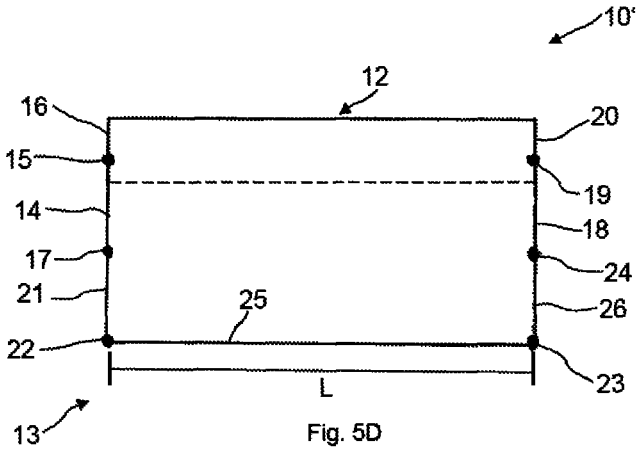

FIG. 5D shows a further state of the rack 10'. In the state shown in FIG. 5D the fourth portion 25 of the base 13 runs parallel to the insertion plane S and the first, second, third and fifth portions 14, 18, 21, 26 run perpendicular, in other words in the heightwise direction of the domestic dishwasher 1, to the insertion plane S. In other words the fourth portion 25 runs parallel to the insertion plane S over the entire projected surface of the frame 12.

Figure 6:
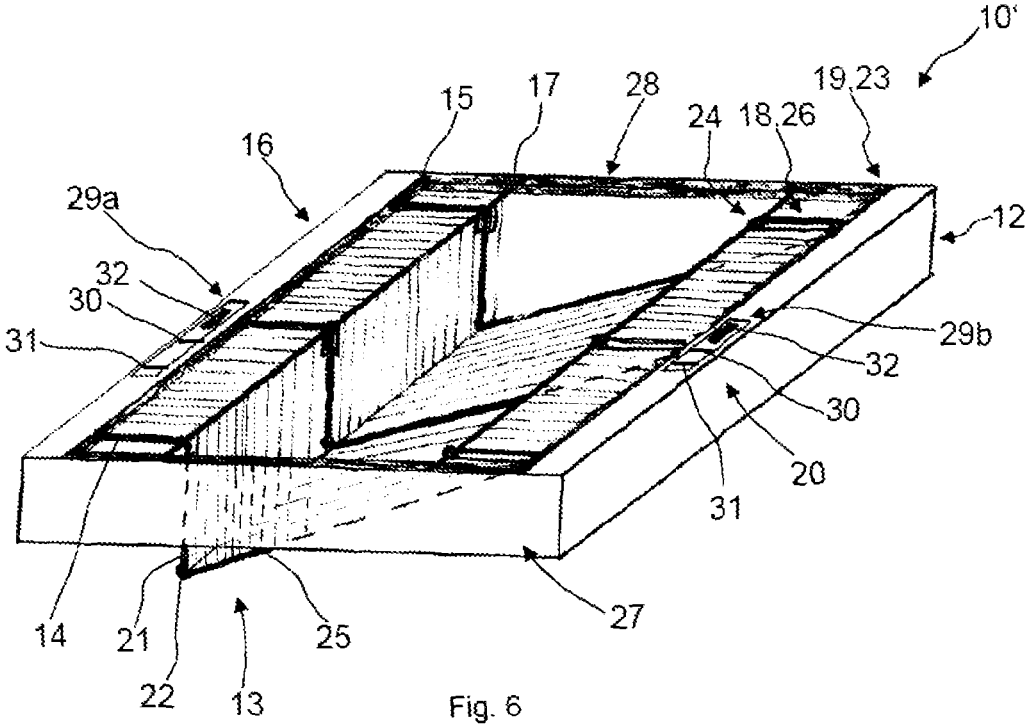
FIG. 6 shows a perspective schematic view of the rack according to the further embodiment.

FIG. 6 shows a perspective schematic view of the rack 10' shown in FIG. 4. The rack 10' here is in a state mirroring the state shown in FIG. 5B. In this state the fourth portion 25 runs at an angle to the insertion plane S of the rack 10'. To transition the rack 10' from one state to the other, the rack 10' has a locking apparatus 29.

The locking apparatus 29 comprises two parts 29*a*, 29*b*, each arranged on one side 16, 20 of the rack 10'. Each part 29*a*, 29*b* of the locking apparatus 29 is designed to lock or release at least one first and/or second portion 14, 21 or 18, 26, which is arranged on a respective side. For example the locking apparatus 29*a*, which is arranged on the first side 16, can lock or release the first portion 14 and the third portion 21. The locking apparatus 29*b*, which is arranged on the second side 20, can lock or release the second portion 18 and the fifth portion 26. The locking apparatus 29, 29*a*, 29*b* has a displacement element 32, which can be displaced by a user of the rack 10'. When a respective displacement element 32 is in a first position 30, the locking apparatus 29, 29*a*, 29*b* locks a first portion 14, 18 and when a respective displacement element 32 is in a second position 31, the locking apparatus 29, 29*a*, 29*b* locks a first portion 14, 18 and a second portion 21, 26 of the base 13. A latching and counter-latching element is arranged on the respective locking apparatus 29, 29*a*, 29*b* and the respective portion 14, 18, 21, 26 for this purpose. When the displacement element 32 of the locking apparatus 29, 29*a*, 29*b* is displaced to the first position 30, the respective portion 14, 18, 21, 26 that was locked can be released. When the displacement element 32 is displaced to the second position 31, the next locked portion is released. The displacement element 32 and with it the locking apparatus 29, 29*a*, 29*b* can be pushed back to their starting position by means of a compression spring.

Figure 7:
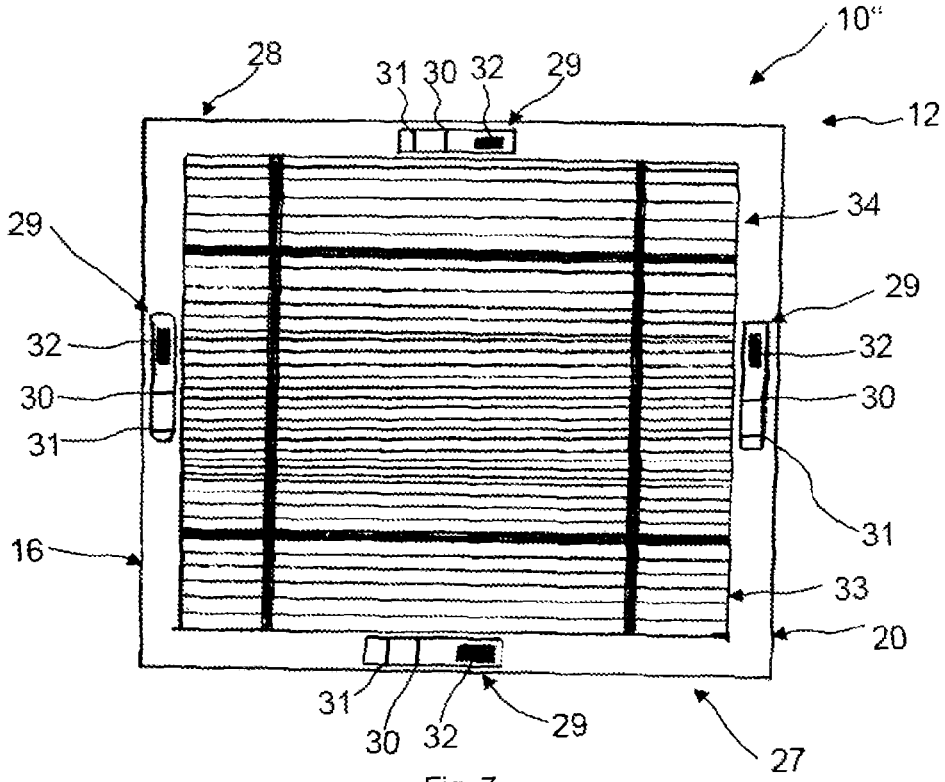
FIG. 7 shows a perspective schematic view of a rack according to another further embodiment.

FIG. 7 shows a perspective schematic view of a rack 10" according to a further embodiment. With the rack 10" shown in FIG. 7 further portions of the base on a third and fourth side 27, 28 of the frame 13 can additionally be folded out. In other words the rack 10" can be folded out both to the sides as well as to the front and rear in the insertion direction E.

Although the present invention has been described based on exemplary embodiments, it can be modified in many different ways.

The invention claimed is:

1. A domestic dishwasher, comprising a rack including a frame and a base configured to be folded out to increase a loading volume of the rack, said base including a first portion articulated to a first side of the frame via a first articulation, and a second portion articulated to a second side of the frame opposite the first side via a second articulation and to the first portion via a third articulation, said second portion being configured to change its length between the second and third articulations.

2. The domestic dishwasher of claim 1, wherein the second portion has two elements configured to telescope into one another.

3. The domestic dishwasher of claim 1, wherein the base is configured to be transitioned to a first state and a second state by pivoting the first and second portions, said base being parallel to an insertion plane spanned by an insertion direction of the rack into the domestic dishwasher and to a direction of a width of the domestic dishwasher, when the rack is used in the domestic dishwasher in the first state, said base being partially at an angle to the insertion plane, when the rack is used in the domestic dishwasher in the second state.

4. The domestic dishwasher of claim 3, wherein the base further includes a third, fourth, and fifth portion articulated to one another via respective articulations.

5. The domestic dishwasher of claim 4, wherein the third portion is articulated to the first portion via the third articulation, the fourth portion is articulated to the third portion via a fourth articulation, and the fifth portion is articulated to the fourth portion via a fifth articulation, and to the second portion via a sixth articulation.

6. The domestic dishwasher of claim 5, wherein the rack is configured to be transitioned to a third state, in which, the base is partially parallel to the insertion plane, when the rack is used in the domestic dishwasher in the third state, and a loading volume in the third state is greater than a loading volume in the first and second states.

7. The domestic dishwasher of claim 6, wherein the base is parallel to the insertion plane over an entire projected surface of the frame onto the insertion plane in the third state.

8. The domestic dishwasher of claim 6, wherein the rack includes a locking apparatus configured to lock the rack in the first state and/or to release the rack into the second state and/or into the third state from the first state.

9. The domestic dishwasher of claim 8, wherein the locking apparatus locks one of the first, second, third, fourth and fifth portions of the base and/or one of the six articulations to lock the rack in the first state.

10. The domestic dishwasher of claim 9, wherein the locking apparatus is configured to lock one of the first and second portions of the base in a first position and to lock the one of the first and second portions and one of the other one of the first and second portions, third and fifth portions of the base in a second position.

11. The domestic dishwasher of claim 8, wherein the locking apparatus has two parts, a first one of the two parts of the locking apparatus being located on the first side of the frame and configured to lock the first and the third portions of the base articulated to the first side of the frame, and a second one of the two parts of the locking apparatus being located on the second side of the frame and configured to lock the second and the fifth portions of the base articulated to the second side of the frame.

12. The domestic dishwasher of claim 11, wherein the two parts of the locking apparatus lock the first, second, third and fifth portions of the base independently of one another.

13. The domestic dishwasher of claim 1, wherein the base further includes a sixth and a seventh portion, said sixth portion being articulated to a third side of the frame via a seventh articulation, and said seventh portion being articulated to a fourth side of the frame via an eighth articulation, said third side being perpendicular to the first side and said fourth side being opposite to the third side.

14. The domestic dishwasher of claim 1, constructed in the form of a flatware drawer.

15. A rack for a domestic dishwasher, comprising:

a frame; and a base configured to be folded out to increase a loading volume of the rack, said base including a first portion articulated to a first side of the frame via a first articulation, and a second portion articulated to a second side of the frame opposite the first side via a second articulation and to the first portion via a third articulation, said second portion being configured to change its length between the second and third articulations.

16. The rack of claim 15, wherein the second portion has two elements configured to telescope into one another.

17. The rack of claim 15, wherein the base is configured to be transitioned to a first state and a second state by pivoting the first and second portions, said base being parallel to an insertion plane spanned by an insertion direction of the rack into the domestic dishwasher and to a direction of a width of the domestic dishwasher, when the rack is used in the domestic dishwasher in the first state, said base being partially at an angle to the insertion plane, when the rack is used in the domestic dishwasher in the second state.

18. The rack of claim 17, wherein the base further includes a third, fourth, and fifth portion articulated to one another via respective articulations.

19. The rack of claim 18, wherein the third portion is articulated to the first portion via the third articulation, the fourth portion is articulated to the third portion via a fourth articulation, and the fifth portion is articulated to the fourth portion via a fifth articulation, and to the second portion via a sixth articulation.

20. The rack of claim 19, wherein the rack is configured to be transitioned to a third state, in which, the base is partially parallel to the insertion plane, when the rack is used in the domestic dishwasher in the third state, and a loading volume in the third state is greater than a loading volume in the first and second states.

21. The rack of claim 20, wherein the base is parallel to the insertion plane over an entire projected surface of the frame onto the insertion plane in the third state.

22. The rack of claim 20, further comprising a locking apparatus configured to lock the rack in the first state and/or to release the rack into the second state and/or into the third state from the first state.

23. The rack of claim 22, wherein the locking apparatus locks one of the first, second, third, fourth and fifth portions of the base and/or one of the six articulations to lock the rack in the first state.

24. The rack of claim 23, wherein the locking apparatus is configured to lock one of the first and second portions of the base in a first position and to lock the one of the first and second portions and one of the other one of the first and second portions, third and fifth portions of the base in a second position.

25. The rack of claim 22, wherein the locking apparatus has two parts, a first one of the two parts of the locking apparatus being located on the first side of the frame and configured to lock the first and the third portions of the base articulated to the first side of the frame, and a second one of the two parts of the locking apparatus being located on the second side of the frame and configured to lock the second and the fifth portions of the base articulated to the second side of the frame.

26. The rack of claim 25, wherein the two parts of the locking apparatus lock the first, second, third and fifth portions of the base independently of one another.

27. The rack of claim 15, wherein the base further includes a sixth and a seventh portion, said sixth portion being articulated to a third side of the frame via a seventh articulation, and said seventh portion being articulated to a fourth side of the frame via an eighth articulation, said third side being perpendicular to the first side and said fourth side being opposite to the third side.

28. The rack of claim 15, constructed in the form of a flatware drawer.

* * * * *